US009493999B1

(12) United States Patent
Swinford

(10) Patent No.: US 9,493,999 B1
(45) Date of Patent: Nov. 15, 2016

(54) SPINNING GAS SEPARATOR FOR DRILLING FLUID

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 0 days.

(21) Appl. No.: 14/987,013

(22) Filed: Jan. 4, 2016

(51) Int. Cl.
*E21B 21/00* (2006.01)
*E21B 43/38* (2006.01)

(52) U.S. Cl.
CPC ..... *E21B 21/002* (2013.01); *E21B 43/38* (2013.01)

(58) Field of Classification Search
CPC ..... E21B 43/38; E21B 43/34
See application file for complete search history.

(56) References Cited

U.S. PATENT DOCUMENTS 5,360,239 A * 11/1994 Klementich ..... F16L 15/001 285/328
6,276,455 B1 * 8/2001 Gonzalez ..... E21B 21/001 166/267
6,322,616 B1 * 11/2001 Kennedy ..... B01D 19/0057 166/105.5
6,547,003 B1 4/2003 Bangash et al.
7,377,336 B2 5/2008 Duhe et al.
7,461,692 B1 * 12/2008 Wang ..... B01D 19/0057 166/105.5
9,080,443 B2 * 7/2015 Henderson ..... E21B 43/38
2002/0178924 A1 * 12/2002 Brown ..... B01D 19/0052 96/214
2009/0304526 A1 * 12/2009 Ford ..... E21B 43/121 417/53
2014/0216720 A1 * 8/2014 Wang ..... B01D 19/0052 166/105.5

* cited by examiner

*Primary Examiner* — Blake Michener
*Assistant Examiner* — Manuel C Portocarrero
(74) *Attorney, Agent, or Firm* — Eric P. Mirabel

(57) ABSTRACT

A gas-separator for separating trapped gases from drilling fluids retrieved from a well-bore being drilled is disclosed. The gas-separator includes a cylindrical separator which is capable of rotating on its longitudinal axis when fluid and gases flow out through fluid ejection ports, which access the center bore of the cylindrical separator. The fluid ejection ports have a narrower cross-section towards the center bore and a wider cross-section at the opposite end, and are preferably aligned substantially tangentially with periphery of center bore, such that outflow of drilling fluid (and gases) from the center bore through the ejection ports induces a rotational torque on the cylindrical separator. Spinning of cylindrical separator enhances the gas-separation effect.

19 Claims, 6 Drawing Sheets

SPINNING GAS SEPARATOR FOR DRILLING FLUID

FIELD OF THE INVENTION

This invention relates to gas-separators used for recycling of drilling fluid, and especially, to gas-separators used for separating trapped gases from recycled drilling fluid.

BACKGROUND

Crude oil and natural gas deposits generally are deep within the earth. To extract oil and gas, a well-bore is drilled into the earth and then crude oil is pumped up using submersible pumps, often in a series.

A well-bore is drilled from an oil-rig on the surface of earth using a rotating drilling bit. The drilling bit is driven using a continuous flow of compressed drilling fluid (also known as "drilling mud") supplied through a conduit, known as a drill string.

When driven, the drilling bits cut through the earth and move deeper in, leaving a tubular well-bore. The inflowing compressed drilling fluid which drives the drill bits gets released at the bottom of the bore, and due to continuous pressurized drilling fluid inflow, released drilling fluid is pushed back to surface of the earth through free space available between the well-bore and the drill string.

On its way back to the surface of the earth, the released drilling fluid carries away with it:

- loose dirt and rock from the bore (most of which is generated during cutting action of the drill bits);
- gases (both trapped gases which were released while drilling the bore and gases which seeped into the bore from gaseous zones/formations surrounding the bore); and
- water and other fluids (including both trapped water and fluids which were released while drilling the bore and others which seeped into the bore from regions/formations surrounding the bore).

After reaching the surface of the earth, the used drilling fluid is collected, filtered and processed for reuse.

Apart from driving the drill bits, the drilling fluid also:

- serves as a lubricant for the drilling bit;
- removes the debris produced by the drill bits while cutting the bore and aids in further deepening it;
- helps cool the drill bits under friction from cutting of the earth bed; and
- provides hydrostatic pressure in the bore which reduces inflow, seeping in and unwanted escape of oil, gases and fluids from regions surrounding the bore.

For a drilling fluid to be able to perform its desired functions, the correct composition and viscosity of drilling fluid must be maintained throughout the cycle. As drilling fluid is recycled, foreign material (such as rock debris and trapped gases) must be filtered out, and it must otherwise be processed to maintain the correct composition and viscosity. If trapped gases are not removed, the drilling fluid cannot provide the desired hydrostatic pressure. Additionally, as trapped gases may be flammable (such as methane or natural gas), there can be a risk of fire or explosion if they are not removed. Some trapped gases, including especially nitrogen and sulfur gas, can react with and corrode the drilling equipment, including the pumps. Trapped gases in the drilling fluid can also cause cavitation or even 'gas-lock' in the pumping equipment.

Over the years, various gas separators have been proposed for removal of trapped gases in the drilling fluid. Currently known gas-separators suffer from drawbacks including inefficiency in gas separation or otherwise; from lack of commercial viability; difficulty in installation in the limited available space of the bore; and inability to protect the pumping equipment. Hence, there's an acute need for a gas-separation equipment that overcomes the deficiencies of the prior art separators.

SUMMARY

The invention is a gas separator for separating trapped gases, including corrosive gases such as sulfur and nitrogen, from drilling fluid (or "mud"), including such fluid recycled from a well-bore which is being drilled.

The gas separator includes a cylindrical separator which is capable of rotating on its longitudinal axis. The cylindrical separator includes a hollow bore and multiple gas ejection ports communicating with the hollow bore. The ports include channels having a narrower cross-section towards the hollow bore and a wider cross-section towards exit of the fluid ejection port, to permit gas expansion on exit. Further, each of said hollow channels is aligned transverse to the axis of the cylindrical separator and substantially tangentially with the periphery of the hollow space such that an outflow of fluid (including gases) contained in said hollow bore through fluid ejection port induces a rotational torque onto the cylindrical separator.

When drilling fluid (having trapped gases) is pumped into the gas separator under pressure, it's delivered to the hollow bore. Continuous inflow forces the drilling fluid (and gases) to exit the bore through the hollow channels and the wider part of the ejection ports. Due to the alignment and configuration of hollow channels and ejection ports, while the gas in the fluid is exiting the ports, it expands and provides the rotational torque (or spinning force) to the cylindrical separator, which in turn generates momentum (sometimes called "centrifugal force") on the drilling fluid in the hollow bore, and forces more gas trapped in the drilling fluid towards the fluid ejection ports—thereby enhancing the gas separation effect.

After the drilling fluid and gases exit the hollow bore through the ejection ports, the separated gases and the drilling fluid follow different paths. While the gases may travel towards one or more gas exit ports on an outer barrel surrounding the first chamber and into the casing space, the gas cleansed drilling fluid travels through the separator and towards drilling fluid pumps which pump the cleansed fluid towards the drill bits.

The gas-separator may be placed in the well-bore, attached in the drilling tool string, during drilling. Several can be used in a series, perhaps even some at the surface and some in the well-bore. It is preferably placed upstream of pumping equipment to remove damaging gases from the drilling fluid prior to pump intake.

Embodiments of the present invention will be discussed in greater details with reference to the accompanying figures in the detailed description which follows.

DETAILED DESCRIPTION

Figure 1:
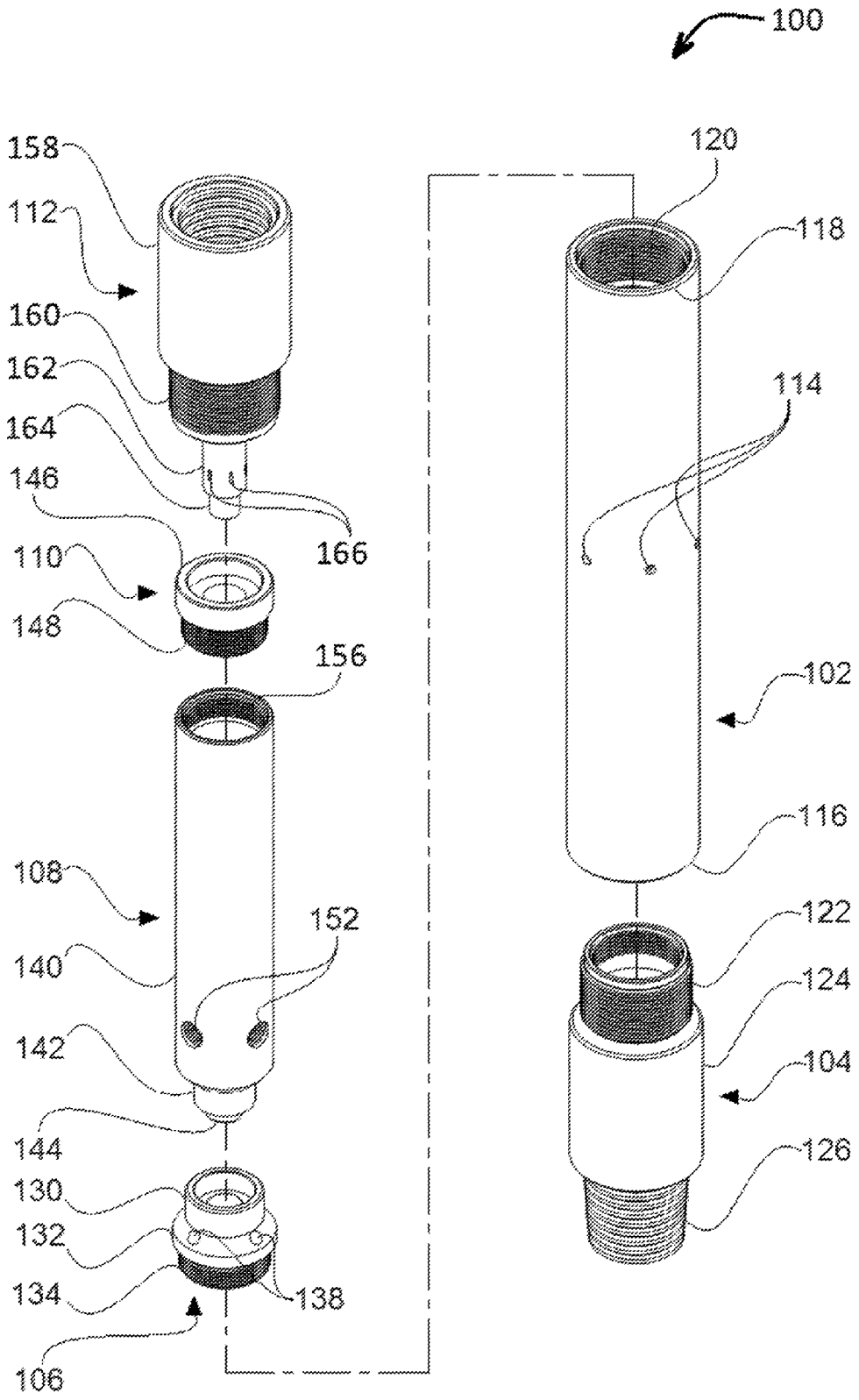
FIG. 1 illustrates an exploded view of parts of a gas separator in accordance with a first embodiment of the present invention.

Reference will now be made in detail to a first embodiment of a gas separator of the invention. As illustrated in FIG. 1, gas-separator 100 includes a hollow cylindrical barrel 102, first fixture 104, first bearing 106, a cylindrical separator 108, second bearing 110 and a second fixture 112. The distal ends of fixtures 104 and 112 (126 and 158, respectively) screw into mating portions of a drilling tool string, as shown schematically in FIG. 4, but not otherwise.

The hollow cylindrical barrel 102 further includes multiple gas exit ports 114 (though more or fewer may be used). In a well-bore, gas exit ports 114 permit gases to pass into the space between the barrel 102 and the casing of the well-bore. Portions of inner surface of the barrel 102 proximal to each of the two ends 116 and 118 are threaded so as to allow, respectively, portions 122 of fixture 104 and 160 of fixture 112 to be screwed into the barrel 102. Threaded portion 120 mates with portion 160 (note that the threaded portion corresponding to end 116 which mates with portion 122 remains hidden in FIG. 1, but is shown in FIG. 2).

Figure 2:
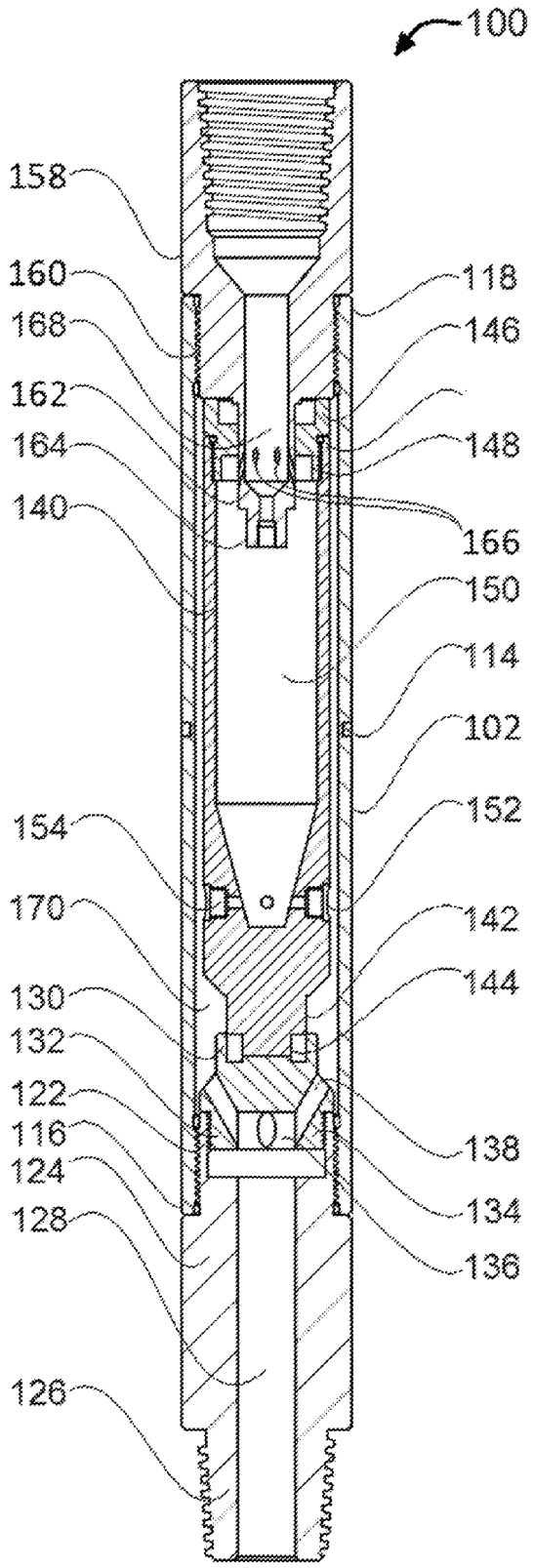
FIG. 2 illustrates a cross-sectional view of the gas separator in accordance with the first embodiment of the present invention.

Fixture 104 includes dual-sided (inner and outer side) threading on connector 122, a mid-portion 124, a tapered threaded extension 126 to connect to the drilling fluid line and a bore 128 running through all portions of fixture 104 (bore 128 is illustrated in FIG. 2).

In gas-separator 100, portion 134 of first bearing 106 is screwed into the interior of portion 122 of fixture 104, and the outer threaded side of connector 122 is screwed into end 116 of barrel 102. First bearing 106 includes, in addition to threaded portion 134, a first cylindrical receiver 130 and an apertured rim 132. The apertured rim 132 further includes several hollow delivery channels 138. Once first bearing 106 is affixed to first fixture 104, bore 128 becomes accessible to hollow delivery channels 138 through hollow region 136 included within threaded portion 134.

Threads 148 of second bearing 110 are screwed into threads 156 of cylindrical separator 108. Cylindrical separator 108 includes first chamber 140, support stub 142 and pivot stub 144. The support stub 142 and pivot stub 144 fittingly mate with corresponding portions in bearing 106. Lower side of stub 142 and the lower side of portion of fluid channel cylinder 162 rests on Bearing 106 and bearing 110 respectively, such that separator 108 can rotate freely on its axis. Bearing 110 includes cylindrical receiver 146 which accommodates fluid channel cylinder 162 and fluid injecting cylinder 164 of fixture 112.

In the cylindrical separator 108, first chamber 140 includes a hollow bore 150 (hollow bore 150 is illustrated in FIG. 2) and includes several fluid ejection ports 152 near the end at which support stub 142 is positioned. Other locations or additional locations of ports 152 are within the scope of the invention.

Figure 3:
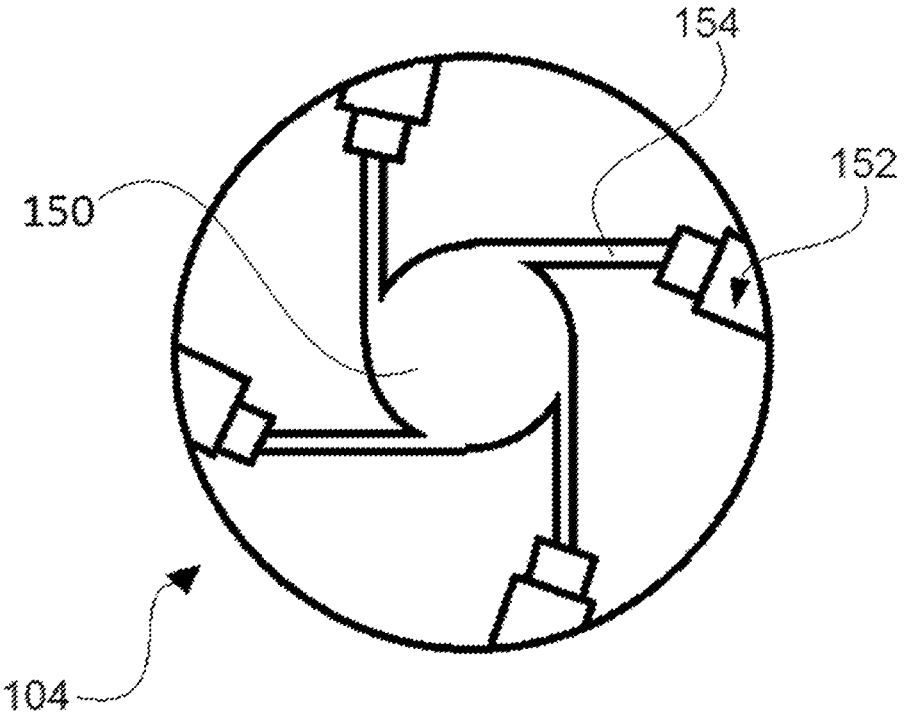
FIG. 3 illustrates a cross-sectional view of the portion of the gas separator of FIGS. 1 and 2 featuring the fluid ejection ports.

Each of the fluid ejection ports 152 extend through outer wall of the first chamber 140, and access hollow bore 150, through a hollow channel 154 (two hollow channels 154 are illustrated in FIG. 2). Hollow channels 154 are narrower towards the hollow bore 150 and have a widened section towards outer periphery of the first chamber 140. Further, hollow channels 154 are oriented substantially tangentially with periphery of longitudinal hollow bore 150, though other orientations which provide rotational force to separator 108 when fluid and gases flow out through ports 152 are also within the scope of the invention. An enhanced view of the preferred orientation of ports 152 (along with their corresponding hollow channels 154) is shown in FIG. 3.

The second fixture 112 comprises a cylinder 158, a threaded cylinder 160, a fluid channel cylinder 162, a fluid injecting cylinder 164 and a longitudinal bore 168 running through each of the cylinder 158, cylinder 160, cylinder 162 and cylinder 164 (longitudinal bore 168 is more clearly illustrated in FIG. 2). As illustrated in FIG. 2, the longitudinal bore 168 varies in shape and dimensions throughout its length. Starting from cylinder 158, the longitudinal bore 168 becomes narrower towards the fluid injecting cylinder 164. Further, the inner surface of cylinder 158 (which surrounds a portion of the longitudinal bore 168) is threaded to connect with threads on the drill string, and the outer surface of cylinder 160 is threaded to mate with threads 156 of separator 108.

Fluid injecting cylinder 164 also includes one or more ports 166 to allow fluid venting and avoid excessive pressure build up inside fixture 112.

Once portion 160 of fixture 112 is screwed into the threaded portion 120 of barrel 102, the end 118 is sealed against the lower edge of cylinder 158.

In the assembled gas-separator 100, longitudinal bore 168 of fixture 112 extends through the second bearing 110 into the hollow bore 150 of the separator 108. Further since longitudinal bore 168 extends into the hollow bore 150, fluids vented by ports 166 are delivered into the hollow bore 150 (See FIGS. 2 and 5). Gas-separator 100 also has an additional chamber 170 formed between the cylindrical barrel 102 and the cylindrical separator 108 (illustrated in FIG. 2).

Figure 4:
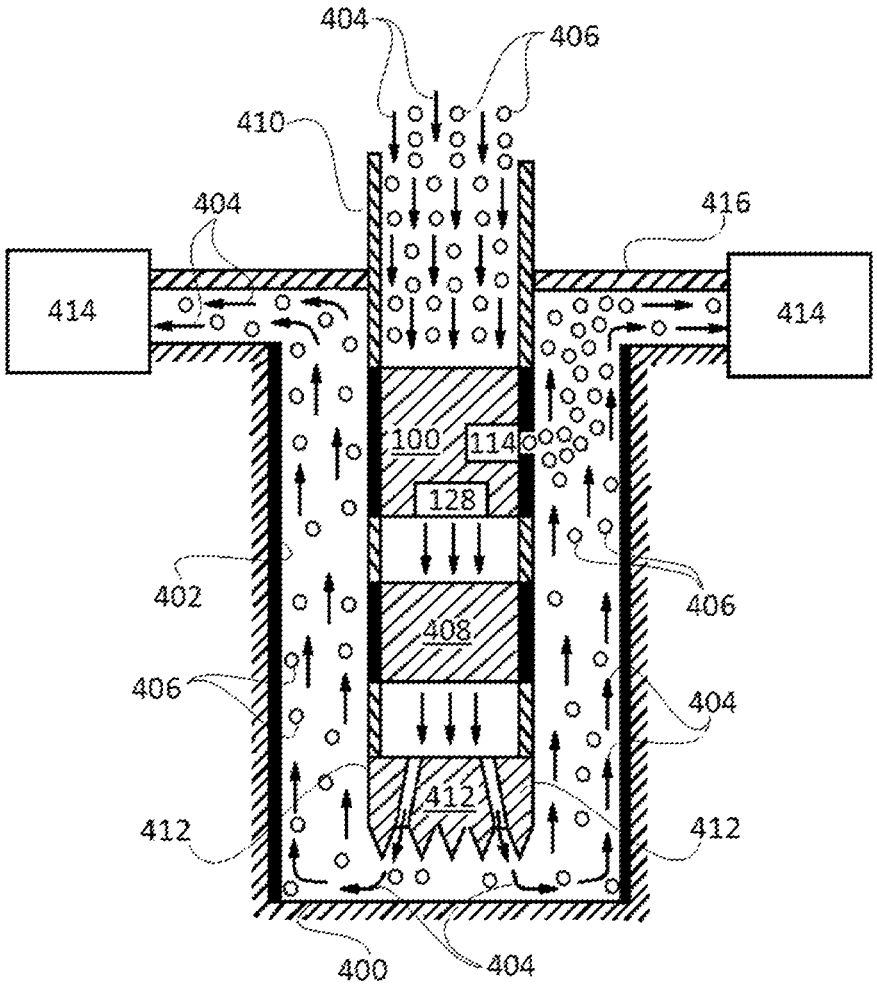
FIG. 4 illustrates positioning of the gas-separator in accordance with the first embodiment of the present invention and the overall process of drilling fluid recycling and gas separation during drilling.
Figure 5:
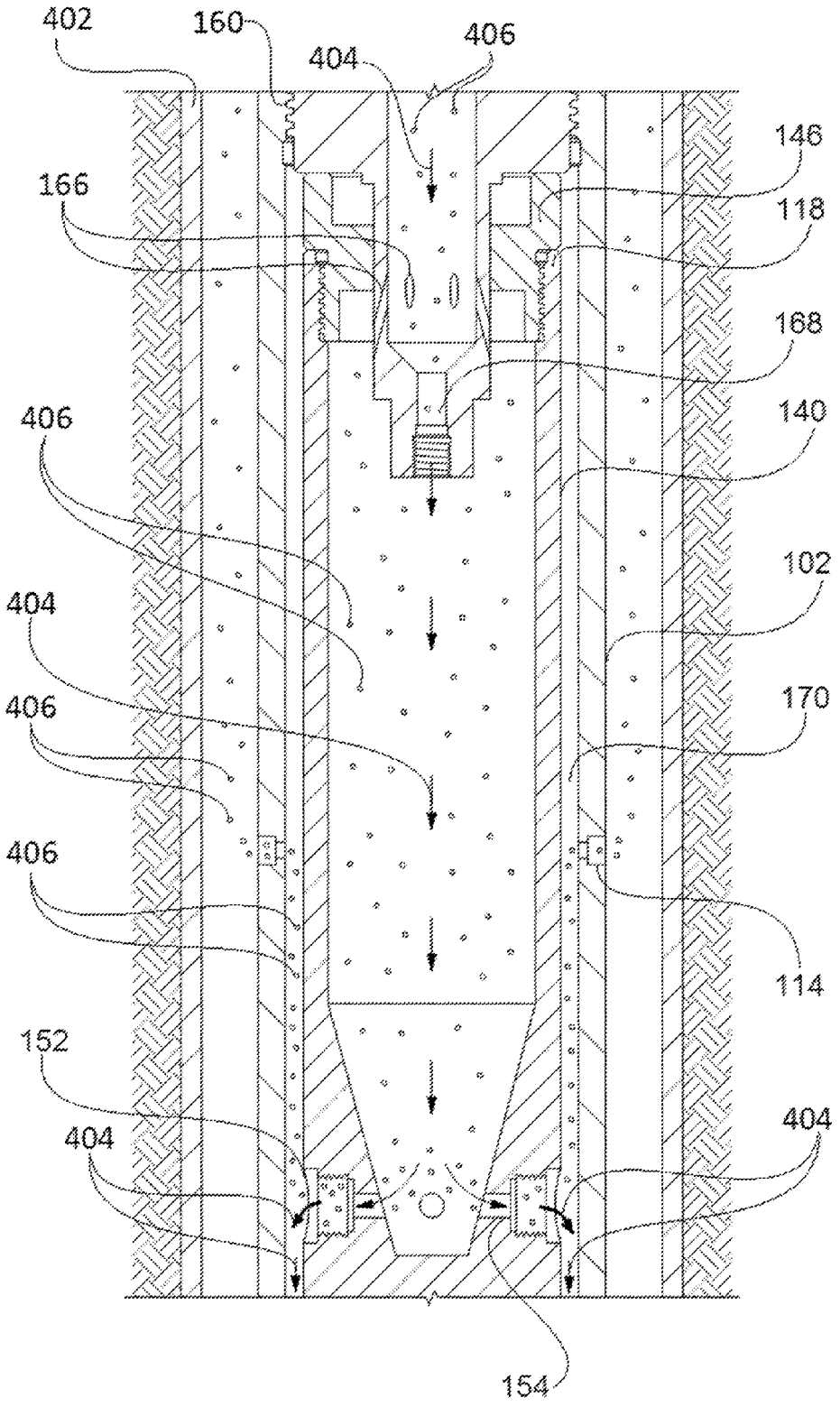
FIG. 5 is a cross-sectional view of a portion the of gas separator illustrating the gas separation therein.
Figure 6:
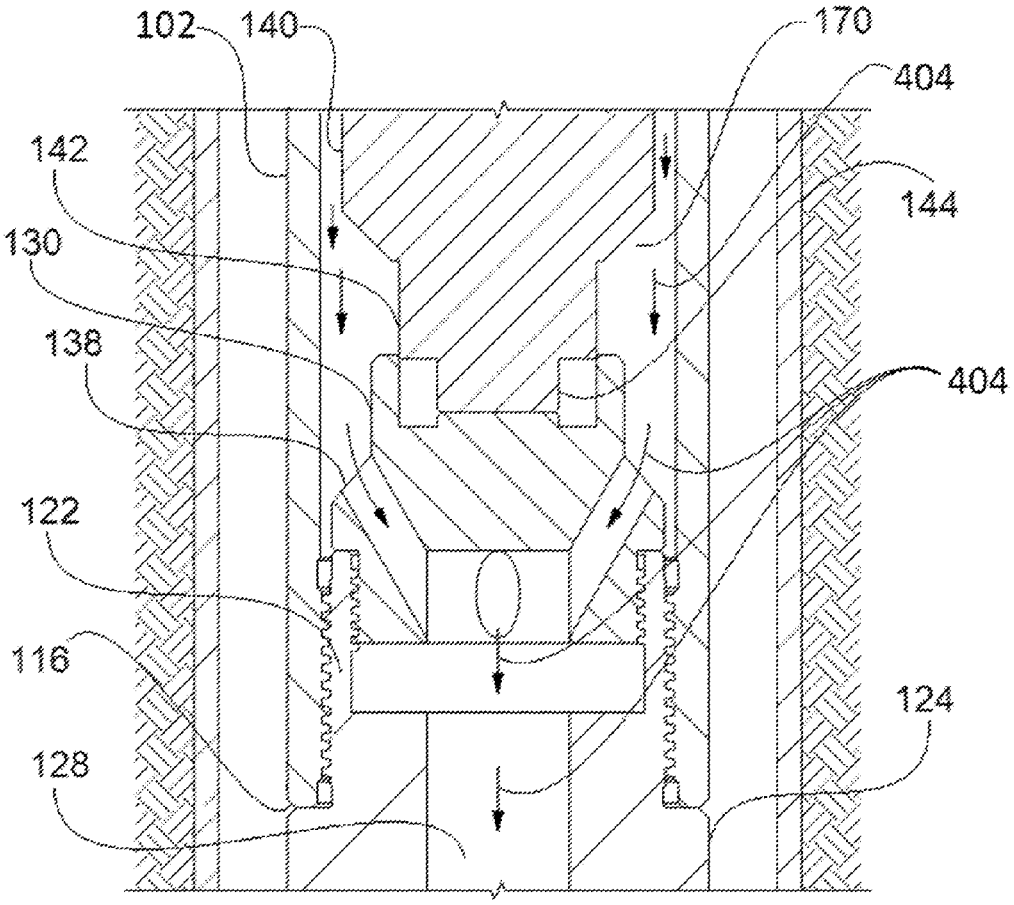
FIG. 6 is a cross-sectional view of a portion the of gas separator illustrating the fluid flow therein. It should be understood that the drawings and the associated descriptions below are intended and provided to illustrate one or more embodiments of the present invention, and not to limit the scope of the invention. Also, it should be noted that the since the drawings are intended to describe the invention with better clarity, they may not be necessarily drawn to scale.

Implementation of gas-separator 100 in a well-bore for separating gases from drilling fluid will now be explained with reference to FIGS. 2, 3, 4, 5 and 6. The drilling fluid to be recycled (retrieved form a well-bore being drilled) includes trapped gases. FIG. 4 illustrates positioning of the gas-separator 100 and an overall process of gas-separation within a well-bore 400 (having a casing 402). In FIGS. 4, 5 and 6, while the drilling fluid and its direction of flow is depicted by arrows 404, the trapped gases in a drilling fluid are depicted as bubbles 406.

As illustrated in FIG. 4, in the well-bore 400, the gas-separator 100 is placed upstream of the PDM motors and pumps (together depicted as 408) in a drilling tool string 410. Removal of the trapped gases, especially nitrogen and sulfur, from the drilling fluid protects the motors and pumps 408 (especially the rubber components of these motors and pumps 408). The motors and pumps 408 receive gas-cleansed drilling fluid 404 from the gas-separator 100, and pass on compressed/pressurized gas-cleansed drilling fluid to drilling bits 412 lying beneath (downstream). When driven by compressed gas-cleansed drilling fluid 404, the drilling bits 412 continue to dig the well-bore 400 further. After driving the drilling bits 412, the drilling fluid 404 is pushed upwards towards the surface of the well-bore 400. On its way to the surface, the drilling fluid 404 carries away material (loose soil, rock chips) and fluids in the well-bore (such as gases 406 and water) along with itself. On reaching the surface, retrieved drilling fluid 404 (including foreign materials such as soil, rock chips, gases and liquids) is collected at recycling units 414 for removal of non-gaseous foreign material. Thereafter, the drilling fluid 404 (along with trapped gases 406) is pumped into the drilling tool string 410. In the string 410, the drilling fluid 404 (along with trapped gases 406) is delivered to the gas-separator 100 for removal of gases 406. After separation, while the gases 406 exit the gas-separator 100 through gas exit ports 114 and are delivered into space between string 410 and casing 402, gas-cleansed drilling fluid 404 is delivered to PDM motors and pumps 408. Finally, motors and pumps 408 deliver compressed gas-cleansed drilling fluid 404 to drilling bits 412, and the process repeats as described. A cover 416 is useful to maintain desired drilling fluid pressure within the well-bore 400. It is noted that since the illustration provided in FIG. 4 is intended to provide a simplified understanding of gas-separation, and other arrangements of components are within the scope of the invention.

FIGS. 5 and 6, illustrate the process of gas separation within the gas-separator 100. The process of gas-separation from drilling fluid 404 (having trapped gases 406) starts with pumping a continuous flow of the compressed/pressurized drilling fluid 404 (having trapped gases 406) into the gas-separator 100 through the longitudinal bore 168. After being fed into the longitudinal bore 168, the compressed drilling fluid 404 (along with trapped gases 406) travels through it and gets delivered into the hollow bore 150. As bore 150 fills with the drilling fluid 404 (and gases 406), due to continuous pressurized inflow, the drilling fluid 404 (and gases 406) contained within bore 150 are forced into channels 154 and ultimately ejected from corresponding fluid ejection ports 152. Due to the alignment and configuration of hollow channels 154 (and their corresponding fluid ejection ports 152) as described above, while the drilling fluid 404 (and gases 406) exit the fluid ejection ports 152, they provide a rotational torque (or spinning force) to the cylindrical separator 108. As a result of continuous ejection of drilling fluid 404 (and gases 406) through fluid ejection ports 152 (and corresponding continuous generation of rotational torque), the cylindrical separator 108 starts spinning about its longitudinal axis. Spinning of cylindrical separator 108 leads to application of centrifugal force on the drilling fluid contained within bore 150 which moves it towards the ports 152 and increases the gas separation from the drilling fluid 404.

After exiting through ejection ports 152, drilling fluid 404 (and gases 406) enter the second chamber 170. In the second chamber 170, buoyant gas bubbles 404 travel towards gas exit ports 114 on barrel 102. While the gases which pass through gas exit ports 114 on the barrel 102 escape up to the surface, gas-cleansed drilling fluid 404 flows into the hollow delivery channels 138 and then to bore 128. From bore 128, the gas cleansed drilling fluid travels to motors and pumps 408, and from there, to drilling bits 412. So, from the second chamber 170, separated gases and the cleansed drilling fluid follow different paths.

Embodiments of gas-separators provided by the present invention are readily deployed in the limited available space within a well-bore. As a result of efficient gas-separation, gas-separators of the invention effectively protect pumping equipment against corrosion, and also against problems such as cavitation (or 'gas-locking') of pumping equipment, and accumulation of inflammable gases (such as methane or natural gas). Additionally, due to efficient gas-separation, gas-separators of the invention also effectively contribute in maintenance of necessary hydrostatic pressure in the well-bore, because they help maintain the requisite composition and viscosity of the recycled drilling fluid.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A cylindrical gas-separator for removing gases from drilling fluid, comprising:

transverse fluid ejection ports accessing the longitudinal bore of the cylindrical separator, wherein said fluid ejection ports are narrower towards the hollow bore and widen towards the exit outside the cylindrical separator, and wherein said fluid ejection ports are aligned such that outflow of drilling fluid and gases from said hollow bore through the fluid ejection ports is substantially tangential with periphery of the cylindrical separator and induces a rotational torque transverse to the cylindrical separator, which is the only force causing the cylindrical separator to rotate on its axis, whereby the rotation forces more drilling fluid and gases in the drilling fluid to outflow through the fluid ejection ports.

2. The gas separator of claim 1, wherein said cylindrical separator is placed in a cylindrical barrel, said cylindrical barrel including one or more gas exit ports.

3. The gas separator of claim 2, wherein said cylindrical separator resides within said cylindrical barrel, and the ends of said cylindrical separator rest on bearings such that it is capable of rotating about its axis.

4. The gas separator of claim 2, wherein said cylindrical barrel is connected to the cylindrical separator at their respective ends such that the space between the outer side of the separator and the inner side of the barrel forms a chamber housing fluid expelled from the ejection ports.

5. The gas separator of claim 1, wherein said cylindrical barrel has fittings attached at its ends to allow it to be connected with a drill string.

6. The gas separator of claim 5, wherein one of said fittings includes a threaded male connector and the other includes a threaded female connector.

7. A drill string for use in forming a well-bore, comprising:

a cylindrical separator having fluid ejection ports accessing the hollow bore of the cylindrical separator, wherein said fluid ejection ports are narrower towards the hollow bore and widen towards the exit outside the cylindrical separator and wherein said fluid ejection ports are aligned such that outflow of drilling fluid and gases from said hollow bore through the fluid ejection ports is substantially tangential with periphery of the cylindrical separator and induces a rotational torque transverse to the axis of said cylindrical separator, which is the only force causing the cylindrical separator to rotate on its axis, whereby the rotation forces more drilling fluid and gases in the drilling fluid to outflow through the fluid ejection ports, and wherein the fluid in the hollow bore flows downstream after the gases have been removed; and at least one drilling fluid motor pump downstream from the cylindrical separator, which pumps fluid supplied to it from the cylindrical separator downstream.

8. The drill string of claim 7, wherein said drill string is connected to drilling bit, said drilling bit lying downstream from said drilling fluid motor pump.

9. The drill string of claim 7, wherein said gas-separator expels fluid and gases into the space between the casing and the drill string.

10. The drill string of claim 7, wherein said cylindrical separator rests on bearings such that it can rotate on its axis.

11. The drill string of claim 7, wherein said separator has fittings attached at its ends to allow it to be connected to the drill string.

12. The gas separator of claim 11, wherein, wherein one of said fittings includes a threaded male connector and the other includes a threaded female connector.

13. A gas-separator for removing gases from drilling fluid in a well-bore, comprising:

a cylindrical barrel having a first end, a second end, and one or more gas exit ports;

a first fixture connected at one end to a first end of said barrel and at the opposite end to a drill string, said first fixture including a first bore;

a second fixture connected at one end to a second end of said barrel and at the opposite end to the drill string, said second fixture including a second bore;

a cylindrical separator within said hollow cylindrical barrel, the interior of said cylindrical separator accessed by several fluid ejection ports, said fluid ejection ports including first narrower channels positioned towards said interior and second wider channels positioned towards the exit of the ports, and wherein said first and second channels are aligned substantially tangentially with the periphery of said cylindrical separator such that an outflow of drilling fluid and gases contained in said interior through the fluid ejection ports induces a rotational torque transverse to the axis of said cylindrical separator, which is the only force causing the cylindrical separator to rotate on its axis, whereby the rotation forces more drilling fluid and gases in the drilling fluid to outflow from the fluid ejection ports;

first and second bearings positioned at either end of the cylindrical separator, said second bearing being annular, said second bearing having a surface abutting said second fixture and forming a fluid flow path from the second bore, through the annulus and to the interior of said cylindrical separator, and from there through the ejection ports; and said fluid flow path continues from the ejection ports to a second chamber formed between the interior wall of the barrel and the outer wall of the cylindrical separator, and from the second chamber to said first bore through the first bearing, and then to the drill string.

14. The gas separator of claim 13, wherein said first fixture is screwed into said hollow cylindrical barrel at said first end.

15. The gas separator of claim 14, wherein said second fixture is screwed into said barrel at said second end.

16. The gas separator of claim 15, wherein said first bearing is placed between said first fixture and said cylindrical separator.

17. The gas separator of claim 16, wherein said second bearing placed between said second fixture and said cylindrical separator.

18. The gas separator of claim 17, wherein said first bearing is affixed to said first fixture.

19. The gas separator of claim 18, wherein said second bearing is affixed to one end of said cylindrical separator.

* * * * *